US006548429B2

(12) United States Patent
Lintecum et al.

(10) Patent No.: US 6,548,429 B2
(45) Date of Patent: Apr. 15, 2003

(54) BICOMPONENT EFFECT YARNS AND FABRICS THEREOF

(75) Inventors: Boyd M. Lintecum, Moneta, VA (US); Richard T Shoemaker, Hixson, TN (US); C Reed Anderson, Jr., Harrison, TN (US)

(73) Assignee: E. I. du Pont de Nemours and Company, Wilmington, DE (US)

( * ) Notice: Subject to any disclaimer, the term of this patent is extended or adjusted under 35 U.S.C. 154(b) by 0 days.

(21) Appl. No.: 09/791,930

(22) Filed: Feb. 23, 2001

(65) Prior Publication Data

US 2002/0045395 A1 Apr. 18, 2002

Related U.S. Application Data

(60) Provisional application No. 60/186,294, filed on Mar. 1, 2000.

(51) Int. Cl.[7] ..... D01F 8/00; D03D 15/00

(52) U.S. Cl. ..... 442/199; 442/200; 428/370; 428/373; 428/374

(58) Field of Search ..... 428/370, 373, 428/374, 397; 57/208, 207; 442/353, 361, 199, 200

(56) References Cited

U.S. PATENT DOCUMENTS

| | | | | |
|---|---|---|---|---|
| 3,671,379 A | | 6/1972 | Evans et al. | |
| 3,959,962 A | | 6/1976 | Wilding | |
| 4,202,854 A | | 5/1980 | Howse, Jr., et al. | |
| 4,244,907 A | | 1/1981 | Wu | |
| 4,601,949 A | | 7/1986 | Bach et al. | |
| 4,740,339 A | | 4/1988 | Bach et al. | |
| 6,015,618 A | | 1/2000 | Orima | |
| 6,020,275 A | | 2/2000 | Stevenson et al. | |
| 6,158,204 A | * | 12/2000 | Talley et al. | 57/208 |

FOREIGN PATENT DOCUMENTS

| | | |
|---|---|---|
| EP | 0165022 A2 | 12/1985 |
| JP | 04370232 A | 12/1992 |
| JP | 07145529 A | 6/1995 |
| WO | WO 9208754 A | 5/1992 |

OTHER PUBLICATIONS

Myazaki, Takao, et al., Database CA Online!, Chemical Abstracts Service, Columbus, OH, US; "Intertwined Composite Yarns and Fabrics" retrieved from STN, Database accession No. 118:235874 XP002179652.

* cited by examiner

*Primary Examiner*—N. Edwards
(74) *Attorney, Agent, or Firm*—Jane O. Hamby

(57) ABSTRACT

A synthetic polymer yarn comprising a bicomponent yarn and a second yarn combined to form a single yarn is disclosed. The bicomponent yarn is made up from a first component and a second component each comprised of a fiber-forming polymer and each having different shrinkages from the other to effectuate a bulking effect. This differential shrinkage may be obtained, for example, by using different polymers or similar polymers having different relative viscosities. The synthetic polymer yarn of the present invention has advantageously exhibited an improved visual effect, including a stratified effect, which improves the visual composition of products produced using the yarn. Moreover, the fabrics produced from the yarn have improved hand and stretch and recovery.

19 Claims, 8 Drawing Sheets

BICOMPONENT EFFECT YARNS AND FABRICS THEREOF

This Application claims priority from and incorporates by reference in its entirely U.S. Provisional Application 60/186,294 filed Mar. 1, 2000.

TECHNICAL FIELD AND INDUSTRIAL APPLICABILITY OF INVENTION

The present invention relates to polymer yarns and particularly, nylon or polyester yarns comprising a bicomponent yarn and a second yarn combined to form a single yarn, useful for manufacturing fabrics and garments.

BACKGROUND OF THE INVENTION

Nylon yarns are used in a variety of knit and woven fabrics. There is an ongoing effort to obtain visually aesthetic fabrics with soft hand and stretch and recovery effects. One effort has led to the production of bicomponent yarns, which have been described in the art. For example, U.S. Pat. Nos. 4,601,949 and 4,740,339 teach polyamide conjugate filaments, or bicomponent yarns, and methods of preparing them using an in-line spinning and stretching method. Similarly, U.S. Pat. No. 3,671,379 discloses bicomponent fibers of poly(ethylene terephthalate) and poly(trimethylene terephthalate), prepared by melt-spinning, drawing, and annealing.

The benefit of bicomponent yarns as described in these patents is that they produce a bulking or crimping effect that is useful in the construction of stretch garments. For example, these patents teach that by using polymers having different shrinkages in the bicomponent yarn, the desired bulking or crimping effect may be attained. This differential shrinkage can be obtained by using different polymers, or using similar polymers with different relative viscosities. However, the fabrics made up solely of bicomponent yarns often do not have the desired visual effects, soft hand, and stretch and recovery.

The present invention relates to a bicomponent effect yarn, comprising a bicomponent yarn and a second yarn, that has been found to obtain the visual effects, soft hand, and stretch and recovery desired. While composite yarns have been described in the art, none of these other yarns have all of the properties desired by the present invention. Composite yarns, for example, have been described in U.S. Pat. No. 6,020,275. Therein, a composite yarn was described in which a load bearing yarn is combined with a fusible bonding yarn or a bulking yarn. However, this yarn was intended as a bonding yarn because of the strength attributed to it and did not attain the visual effects and soft hand attributed to the bicomponent effect yarns of the present invention.

In another patent, U.S. Pat. No. 6,015,618, a composite yarn is described comprising a chain stitch yarn with an inlay yarn inserted into the chain stitch yarn. While this patent was directed to achieving a stretchable fabric, the use of water-soluble yarns and elastomeric yarns are specifically contemplated. The bicomponent effect yarns of the present invention, on the other hand, do not generally use water-soluble yarns and is further able to obtain a stretchable fabric without the use of elastomeric polymers.

In some applications, nylon yarns have been used to cover elastomeric spandex either by twisting or by air jet texturing. As a result, some fabrics made from these yarns have a good stretch and recovery, but often do not have the visual aesthetics associated with the present invention. Moreover, spandex is a rubbery fiber, which does not absorb dyes well, unlike the bicomponent effect yarns of the present invention. Also, because spandex is a rubbery fiber, it does not provide the desired soft feel or "hand" as compared to the present invention.

Thus, the present invention is directed to a bicomponent effect yarn that may be knitted or woven into fabrics having desired visual impact, hand, and stretch and recovery. Moreover, because these woven fabrics are preferably made of nylon yarns, they are also dyeable and durable. The texture of the fabrics made from the yarns of the present invention has a smooth and velvety hand as compared to other fabrics that are known.

U.S. Pat. No. 3,671,379 describes a blend of a polyester bicomponent staple fiber and a second polyester staple fiber. See, e.g., example XXV. However, combinations of yarns or continuous filaments are not proposed.

SUMMARY OF THE INVENTION

The present invention relates to a polymer yarn comprising a bicomponent yarn and a second yarn combined to form a single yarn. The bicomponent yarn comprises at least a first component and a second component each comprised of a fiber-forming polymer and each preferably having different shrinkages, which effectuate a bulking effect. This may be obtained, for example, by using different polymers or using polymers having different relative viscosities. The polymer yarn of the present invention has advantageously exhibited an improved visual effect, including a stratified effect, which improves the visual composition of products produced using the yarn. Moreover, the polymer yarn of the present invention often provides an unexpectedly soft hand and good stretch and recovery to fabrics produced from it. The soft hand was particularly marked in knit fabrics.

In another embodiment of the invention, products produced using the polymer yarn are described. In particular, a fabric comprising the polymer yarn may be produced using the polymer yarn. Furthermore, garments made from such fabrics are taught.

In yet another embodiment, a process of making the polymer yarn comprises combining a bicomponent yarn with a second yarn to form a single yarn, wherein the bicomponent yarn comprises at least a first component and a second component each comprised of a fiber-forming polymer and each having shrinkages different from each other. The process may further include, prior to said combining step, producing the bicomponent yarn from its first and second filament components.

DETAILED DESCRIPTION OF A PREFERRED EMBODIMENT OF THE INVENTION

Figure 1:
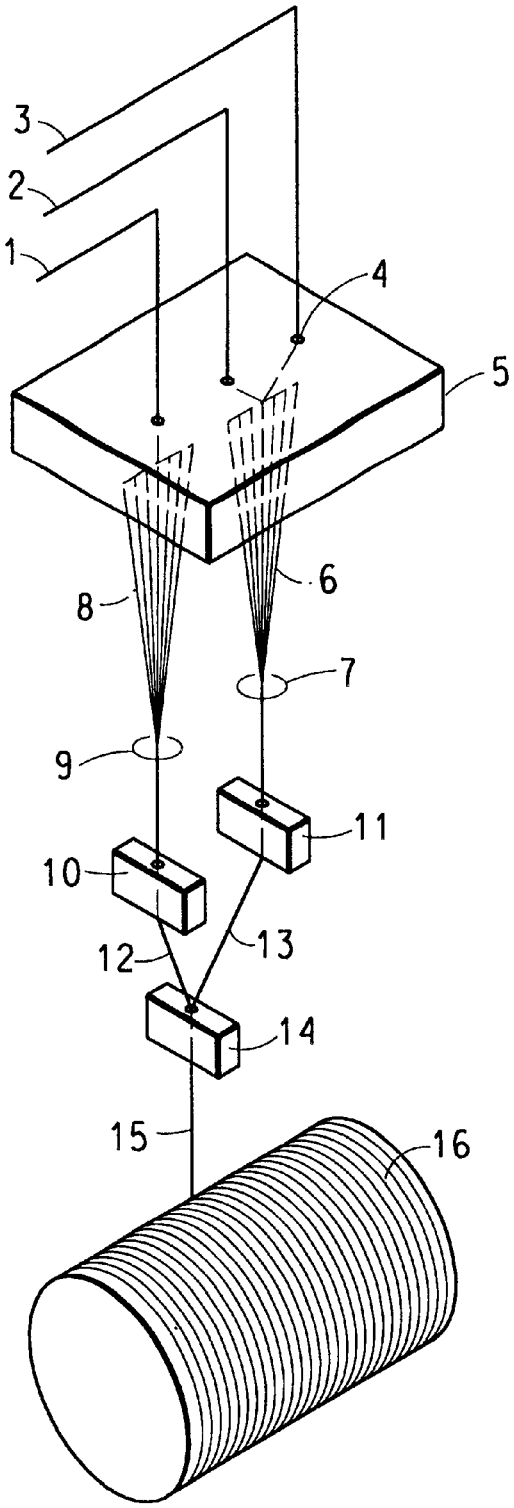
FIG. 1 is a schematic drawing of one method of making a polymer yarn of the present invention, which is partially oriented, using the bicomponent yarn and a second yarn by interlacing.

The term, "synthetic polymer yarn" or "bicomponent effect yarn," as used herein refers to the single yarn of the present invention produced by combining the bicomponent yarn and the second yarn. Synthetic yarn includes those embodiments that are wholly or partly synthetic. The terms stratified yarn, and combined yarn, are also sometimes used below to describe the yarn of the invention.

Fabrics made from this yarn have the visual, hand, and stretch and recovery effects, which are an aim of this invention.

The term, "bicomponent yarn," as used herein, refers to a conjugated product of at least two melt-spinnable fiber components, wherein the conjugated product has at least two different longitudinally coextensive polymeric segments. The fiber components are composed of any suitable melt-spinnable fiber-forming polymers known in the art. Suitable fiber-forming polymers for the first and/or second component of the bicomponent include any homopolymers, copolymers, and terpolymers of polyamides, polyolefins, such as polyethylene and polypropylene, polyesters, viscose polymers, such as rayon, and acetate. The term, "bicomponent," is not intended to be limited to only two components, but is intended to include three or more components, which would produce a conjugated product having at least three or more different longitudinally coextensive polymeric segments. Such bicomponent can be termed multicomponent fibers.

A preferred bicomponent fiber is a fiber comprising a pair of polymers intimately adhered to each other along the length of the fiber, so that the fiber cross-section is for example a side-by-side, eccentric sheath-core or other suitable cross-section from which useful crimp can be developed. Also, preferably the fiber has considerable bulk.

The term, "shrinkages," as used herein, refers to the reduction of the longitudinal dimension of each of the components of the bicomponent yarn when exposed to moist heat. This differential shrinkage between the components of the bicomponents yarn may be attained by selecting fiber-forming polymers that differ in one or more of the types of polymers, properties of the polymers, such as relative viscosity, crystallizable properties, cross-section, the amount of additives present in each polymeric segment, or a combination of these properties. These differences in the components of the bicomponent yarn provide the differential shrinkage to effectuate a bulking effect or different longitudinally coextensive polymeric segments. The components of the bicomponent yarn may be arranged as desired, for example, in a side-by-side or sheath-core arrangement. To give the best aesthetic effect, the sheath-core should preferably have an eccentric or asymmetric sheath-core arrangement.

Suitable homopolyamides include, but are not limited to, polyhexamethylene adipamide homopolymer (nylon 66); polycaproamide homopolymer (nylon 6); polyenanthamide homopolymer (nylon 7); nylon 10; polydodecanolactam homopolymer (nylon 12); polytetramethyleneadipamide homopolymer (nylon 46); polyhexamethylene sebacamide homopolymer (nylon 610); the polyamide of n-dodecanedioic acid and hexamethylenediamine homopolymer (nylon 612); and the polyamide of dodecamethylenediamine and n-dodecanedioic acid homopolymer (nylon 1212). Copolymers and terpolymers of the monomers used to form the above-mentioned homopolymers are also suitable for the present invention.

Suitable copolyamides include, but are not limited to, copolymers of the monomers used to form the above-named homopolyamides. In addition, other suitable copolyamides include, for example, nylon 66 contacted and intimately mixed with nylon 6, nylon 7, nylon 10, and/or nylon 12. Illustrative polyamides also include copolymers made from dicarboxylic acid component, such as terephthalic acid, isophthalic acid, adipic acid, or sebacic acid; an amide component, such as polyhexamethyleneterephthalamide, poly-2-methylpentamethyleneadipamide, poly-2-ethyltetramethyleneadipamide, or polyhexamethyleneisophthalamide; a diamine component, such as hexamethylenediamine and 2-methylpentamethylenediamine; and 1,4-bis (aminomethyl)cyclohexane. Preferably, one component of the bicomponent yarn is a copolyamide of nylon 66 copolymerized with poly-2-methylpentamethyleneadipamide (MPMD). This copolyamide may be made by polymerizing adipic acid, hexamethylenediamine, and MPMD together. Most preferably, one component of the bicomponent yarn is a copolyamide of nylon 66 copolymerized with poly-2-methylpentamethyleneadipamide, and the second component is nylon 66.

The above copolyamides may be made by methods known in the art. For example, a suitable copolyamide may be made by mixing fixed proportions of each polyamide component in the form of flake or polymer granulate and extruding as a homogeneous filament. Alternatively, the copolyamide may be made by mixing the appropriate monomers in an autoclave and carrying out the polyamidation process as is known in the art. Either process is suitable for making the copolyamides employed in this invention.

Terpolyamides of the monomers used to form the above-mentioned homopolymers may also be suitable for the present invention and may be made by processes known in the art.

The fiber-forming polymers of the bicomponent yarn may also be any known polyesters, including polyethylene terephthalate (PET), polyethylene naphthalate, polypropylene terephthalate, and polybutylene terephthalate. Poly (propylene terephthalate) is also known as poly (trimethylene terephthalate) and poly(butylene terephthalate) as poly(tetramethylene terephthalate). The polyesters may be homopolymers or copolymers of these polyesters. The polyesters can be made by processes known in the art.

Preferred polyesters are described next. The notation "// " is used to separate the two_polymers used in making a bicomponent fiber. "2G" means ethylene glycol, "3G" means 1,3-propane diol, "4G" means 1,4-butanediol, and "T" means terephthalic acid. Thus, for example, "2G-T// 3G-T" indicates a bicomponent fiber comprising poly (ethylene terephthalate) and poly(trimethylene terephthalate).

The two polyesters of the polyester bicomponent used in the bicomponent effect yarn of the present invention can have different compositions, for example 2G-T and 3-G-T (preferred) or 2G-T and 4G-T, and preferably have different intrinsic viscosities. Alternatively, the compositions can be the same, for example 2G-T, but the intrinsic viscosities can be different. Other useful polyesters include poly(ethylene 2,6-dinaphthalate, poly(trimethylene 2,6-dinaphthalate), poly(trimethylene bibenzoate), poly(cyclohexyl 1,4-dimethylene terephthalate), poly(1,3-cyclobutane dimethylene terephthalate), and poly(1,3-cyclobutane dimethylene bibenzoate). It is advantageous for the polymers to differ both with respect to intrinsic viscosity ("IV") and composition, for example, 2G-T having an IV of about 0.45–0.80 dl/g and 3G-T having an IV of about 0.85–1.50 dl/g, to achieve a high after-heat-set crimp contraction value.

One or both of the polyesters of the polyester bicomponent fiber can be copolyesters. For example, a copoly (ethylene terephthalate) can be used in which the comonomer used to make the copolyester is isophthalic acid, pentanedioic acid, hexanedioic acid, 1,3-propane diol, or 1,4-butanediol. The comonomer can be present in the copolyester at levels of about 0.5–15 mole percent. Use of a copolyester can be especially useful when both polyesters are otherwise the same, for example 2G-T//2G-T/I. The copolyester(s) can also contain minor amounts of other comonomers such as 5-sodium-sulfoisophthalate at a level of about 0.2–5 mole percent, provided such comonomers do not have an adverse affect on the beneficial effects of the invention.

The polymers used to make up the bicomponent yarn may have any cross-sectional shape. The cross-sectional shapes, for example, may include round, oval, trilobal, shapes with higher numbers of symmetric lobes, and dog-boned shape.

The polymers used in the bicomponent yarn or second yarn according to the invention can comprise, as further constituents, conventional additives that may contribute towards improving the polymer properties. Examples of these additives include antistatics, antioxidants, antimicrobials, flameproofing agents, lubricants, dyestuffs, light stabilizers, polymerization catalysts and auxiliaries, adhesion promoters, delustrants, such as titanium oxide, matting agents, and/or organic phosphites.

Each of the components of the bicomponent yarn is present in an amount sufficient to obtain a differential shrinkage necessary to get a bulking effect and may be obtained by known methods. For example, the differential shrinkage may be obtained by utilizing different types of polymers, components having different properties, such as relative viscosity and crystallizable properties, or using different ratios of the components. For example, one component of the bicomponent yarn may be formed from a rapidly crystallizable fiber-forming polyamide, whereas the other component of the bicomponent yarn is formed from a less rapidly cystallizable fiber-forming polyamide. As taught in U.S. Pat. No. 4,740,339, herein incorporated by reference, the difference in crystallizability may be achieved by selecting polyamides having different terminal velocity distances, which, in turn, give rise to a greater bulking as indicated by a high-load crimp test value.

On the other hand, the components of the bicomponent yarn may be selected based on differences in relative viscosity. When one component of the bicomponent yarn is composed of structural repeating units of the same chemical formula as the other component of the bicomponent yarn, selection of the polymer having different relative viscosities results in the desired bulking effect. The difference in relative viscosity of the components of the bicomponent yarn should be sufficient to obtain a differential shrinkage sufficient to attain a bulking effect. For example, when nylon 66 polyamides of different relative viscosities (RV) are used to form the polymeric segments, the difference in RV between the two nylon 66's should be at least 5, preferably at least 15, and most preferably at least 30 with the RV of the low RV nylon 66 being at least 20, for example, at least 50, or at least 65. Preferably, the components of the bicomponent yarns are composed of the same repeating structural unit, but have different RV's.

Alternatively, the differential shrinkage may be attained by varying the ratio of each of the components in the bicomponent yarn or using different types of polymers for each component. Again, the amounts of each of the components in the yarn should be an amount sufficient to obtain a differential shrinkage sufficient to attain a bulking effect.

The "bulking effect," as used herein, refers to the inherent ability of the bicomponent yarn to crimp and may be effectuated by having a differential shrinkage between the components of the bicomponent yarn. The bicomponent yarns' inherent ability to crimp advantageously allows the bicomponent yarns to be "self-bulking" because they do not require a mechanical draw twisting or texturing process in bulking these types of fibers. Some fabrics made entirely from fibers of this type can have stretch and recovery properties and handle similar to those from mechanically textured fibers. When a 2G-T//3G-T bicomponent is used, there is often provided much higher stretch and recovery than textured fibers do.

The bulking effect may be ascertained objectively by measuring the crimp potential and/or crimp shrinkage of the bicomponent yarn used in the present invention. In particular, the crimp potential is a measure of the bulk developed in yarn by exposure to moist heat. The difference between the stretched (or loaded) length and the unstretched (or not loaded) length after crimping/bulking treatment is expressed as a percent of the stretch length. Crimp shrinkage, on the other hand, is a measure of yarn shrinkage caused by exposure to moist heat. The crimp shrinkage is the difference between stretched length before and after treatment expressed as a percent of the stretched length before treatment. The crimp potential and crimp shrinkage are directly proportional to each other. In other words, the greater the crimp potential, the greater the crimp shrinkage. A suitable bulking effect may depend upon the final application that is intended of the synthetic polymer yarn of the present invention. Generally, a suitable bulking effect is attained with a bicomponent yarn having at least about 10% crimp potential, preferably at least about 30%, and most preferably at least about 45%. A suitable bulking effect may further be obtained with a bicomponent yarn having at least about 10% crimp shrinkage, preferably at least about 30% crimp shrinkage, and most preferably at least about 45%.

Unless otherwise noted, the crimp contraction level ("CCa") of the polyester bicomponent fibers used in the Examples was measured as follows. Each sample was formed into a skein of 5000 +/−5 total denier (5550 dtex) with a skein reel at a tension of about 0.1 gpd (0.09 dN/tex). The skein was conditioned at 70 +/−2F (21 +/−1C) and 65 +/−2% relative humidity for a minimum of 16 hours. The skein was hung substantially vertically from a stand, a 1.5 mg/den (1.35 mg/dtex) weight (e.g. 7.5 grams for a 5550 dtex skein) was hung on the bottom of the skein, the weighted skein was allowed to come to an equilibrium length, and the length of the skein was measured to within 1 mm and recorded as "Cb". This 1.35 mg/dtex weight was left on the skein for the duration of the test. Next, a 500 gram weight (100 mg/d; 90 mg/dtex) was hung from the bottom of the skein, and the length of the skein was measured to within 1 mm and recorded as "Lb". Crimp contraction value (percent) (before heat-setting, as described below for this test), "CCb", was calculated according to the formula $$CCb=100\times(Lb-Cb)/Lb$$

The 500 g weight was removed, and the skein was then hung on a rack and heat-set, with the 1.35 mg/dtex weight still in place, in an oven for 5 minutes at about 250° F. (121° C.), after which the rack and skein were removed from the oven and conditioned as above for two hours. This step is designed to simulate commercial dry heat-setting, which is one way to develop the final crimp in the bicomponent fiber. The length of the skein was measured as above, and its length was recorded as "Ca". The 500-gram weight was again hung from the skein, and the skein length was measured as above and recorded as "La". The after heat-set crimp contraction value (percent), "CCa", was calculated according to the formula $$CCa=100\times(La-Ca)/La."$$

The bicomponent yarn may be arranged, for example, either in a side-by-side or asymmetrical sheath-core arrangement. For example, U.S. Pat. No. 4,601,949, herein incorporated by reference, describes the side-by-side arrangement that may be obtained. Preferably, the arrangement is side-by-side.

The methods of making the bicomponent yarns are known in the art and may be formed according to any known method. For example, U.S. Pat. No. 4,740,339, herein incorporated by reference, describes a process of making bicomponent yarns having different relative viscosities by a spin-stretch process to form a side-by-side configuration along the length of the filaments. Another known method is described in U.S. Pat. Nos. 4,244,907 and 4,202,854, both herein incorporated by reference, wherein a process of making bicomponent yarns by extruding a single polymer to form a monocomponent molten stream may be treated by one-sided cooling before it is completely solidified or one-sided heating immediately after is it completely solidified and then subjecting the filament to stretching. The stretching of the bicomponent yarns may be conducted according to known means, such as by heating or steaming the yarn and allowing the bicomponent yarn to then bulk. Moreover, the bicomponent yarns may be made in a continuous manner contiguously with the production of the synthetic polymer yarns of the present invention. Alternatively, the bicomponent yarns may be produced off-line and then combined with the second yarn.

The other component of the synthetic polymer yarn is the second yarn, that is comprised of a man-made or natural fiber. The second yarn can be composed of man-made fiber-forming polymers including, but not limited to, polyamides, polyolefins, such as polyethylene and polypropylene, polyesters, viscose polymers, such as rayon, and acetate, or combinations thereof as described above. In addition, the second yarn may include natural fibers, such as cotton, wool, and/or silk. Preferably, the second yarn is non-elastomeric. Also, preferably the yarn is formed from melt-spinnable polymers or natural fibers. The polymers used may be homopolymers, copolymers, terpolymers, and combinations thereof. The second yarn may be a single fully drawn or hard yarn, or a bicomponent yarn. The bicomponent yarn may be made as described above. In a preferred embodiment, the second yarn is a single fully drawn yarn.

The polymers used to make up the second yarn may have any cross-sectional shape. The cross-sectional shapes, for example, may include round, oval, trilobal, shapes with higher numbers of symmetric lobes, and dog-bone shaped.

Where the second yarn is a single component drawn yarn, it has been found that yarns having less than about 80% elongation to break, preferably less than about 60% elongation to break, more preferably less than about 50% elongation to break, are particularly useful for the present invention.

The combined bicomponent yarn and second yarn may be present in the final product in varying ratios depending on the intended use. The fraction of each of the components of the final product may be measured according to its total denier and denier per filament, for example. The greater the total denier or denier per filament, the greater the amount of the component in the final product. Modifying the components based upon these factors may achieve different functions of the final product. For example, a higher stretch may be obtained by having a greater fraction of the bicomponent yarn in the final product. Conversely, a fabric having less stretch may be obtained by having a greater fraction of the second yarn, where the second yarn is a single component yarn.

Figure 2:
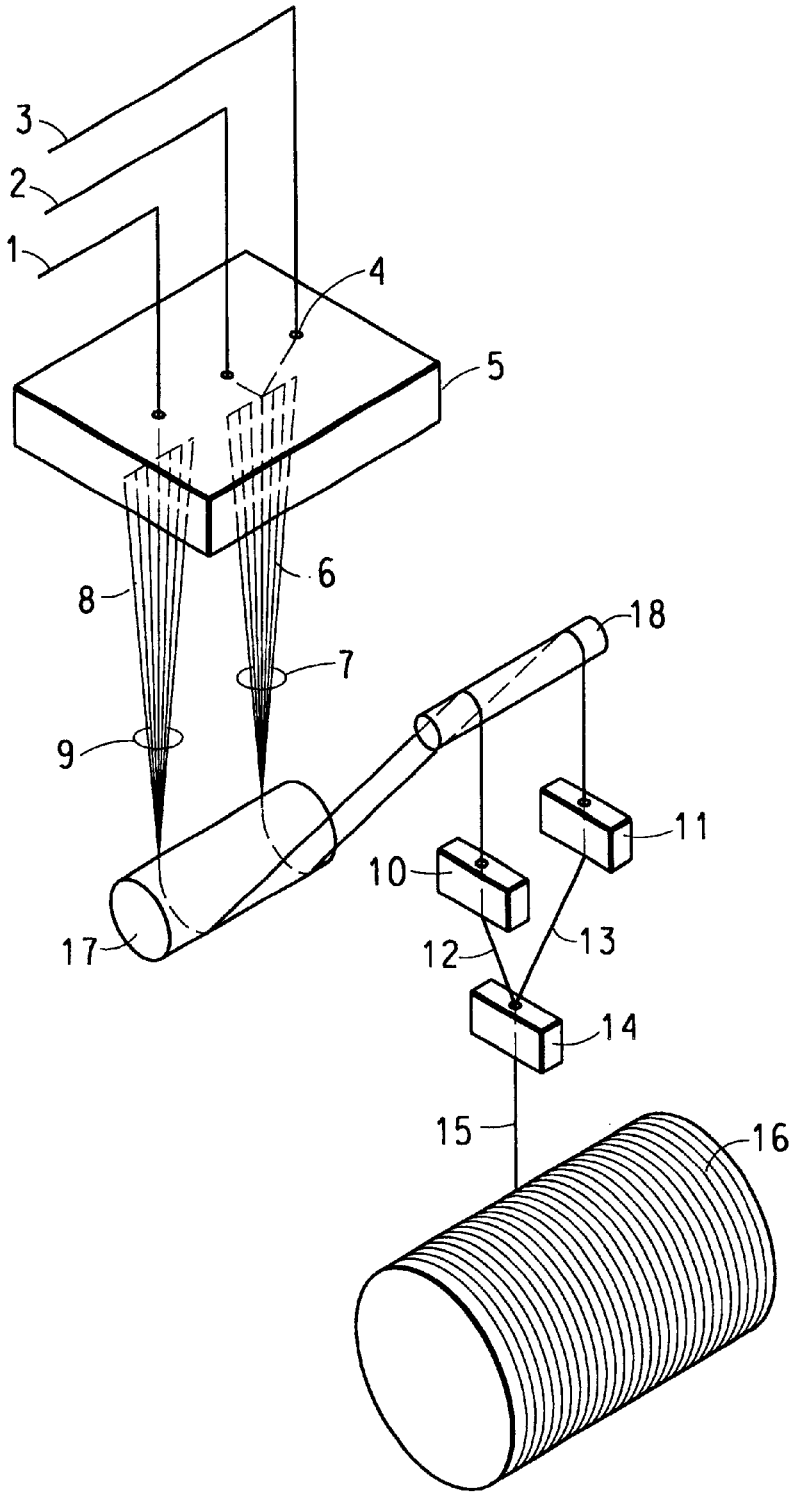
FIG. 2 is a schematic drawing of another method of making a polymer yarn of the present invention, which is fully drawn using the described roll arrangement, wherein the bicomponent yarn and second yarn are interlaced.
Figure 3:
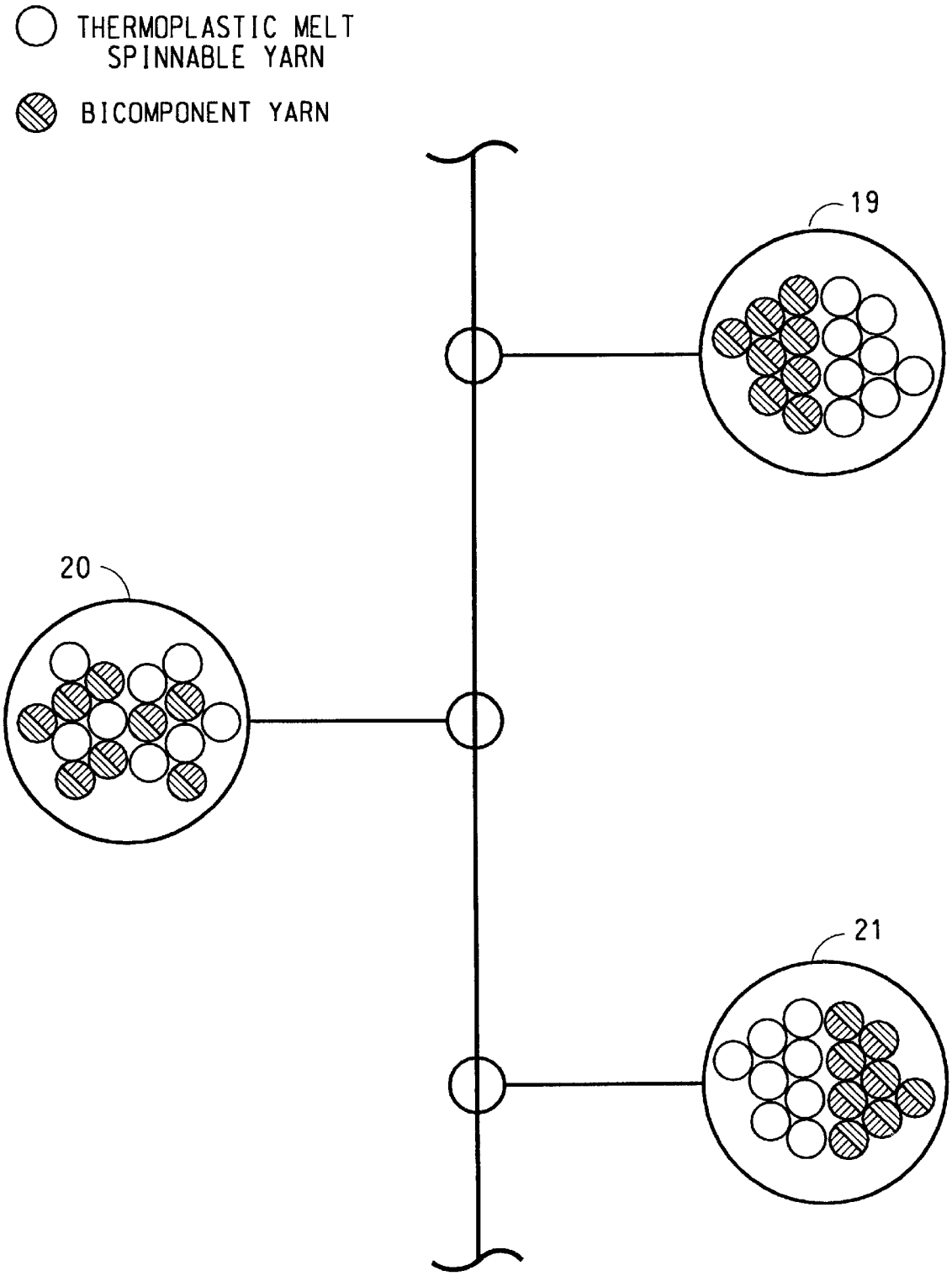
FIGS. 3–5 depict cross-sectional diagrams at three different sections, where the bicomponent yarn has a round cross-section and the second yarn is round, dog-bone shaped, and trilobal, respectively.
Figure 4:
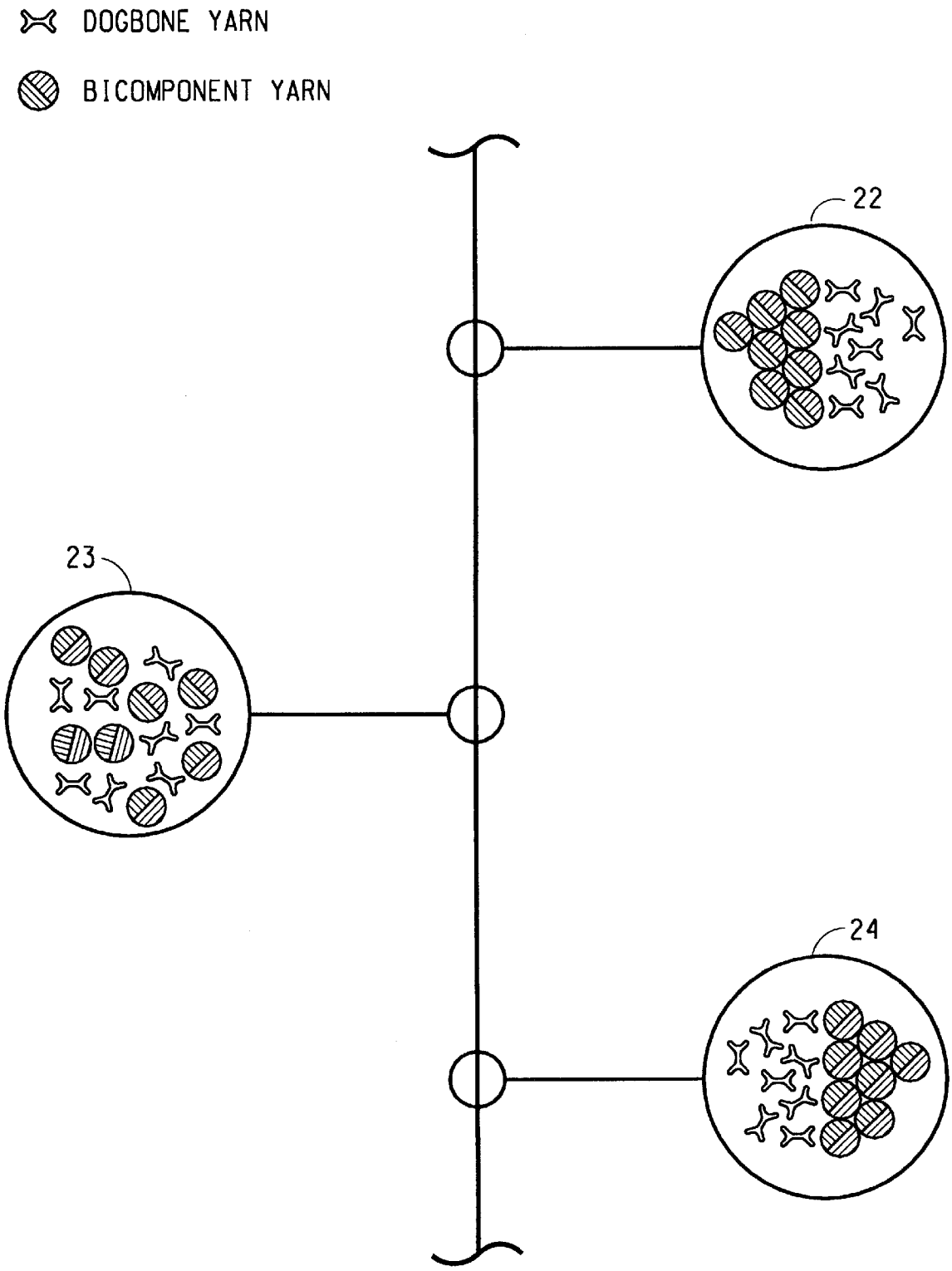
Figure 5:
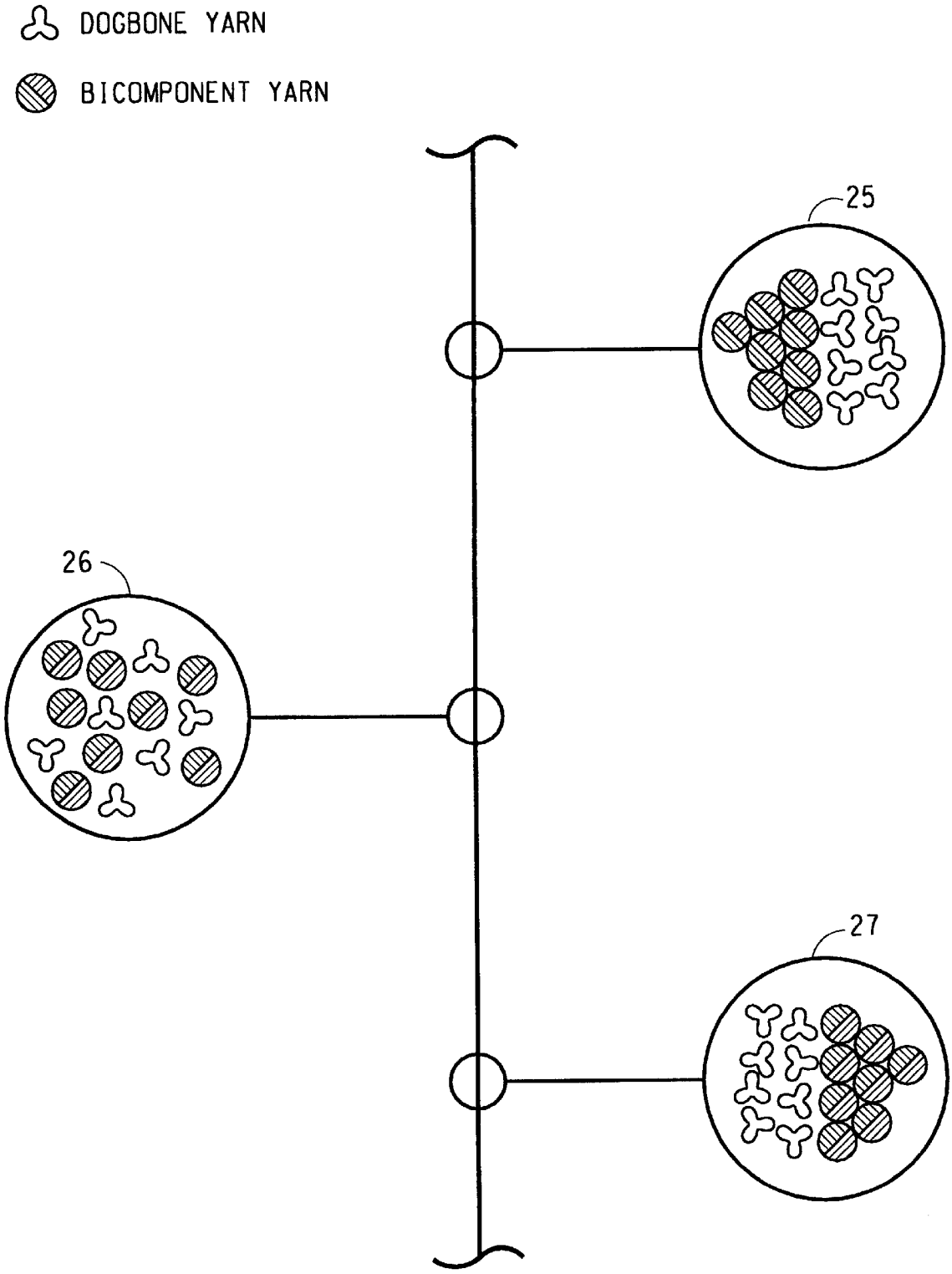

Typical cross-sections of the polymer yarns of the present invention are depicted in FIGS. 3, 4, and 5. These figures depict three different cross-sections of the synthetic polymer yarns produced according to the interlacing method depicted in FIGS. 1 and 2. For example, FIG. 3 depicts a polymer yarn, wherein the bicomponent yarn and the second yarn have round cross-sections. By interlacing or twisting the yarns together, different filament cross-sectional arrays 19, 20, 21 may be obtained. It has been shown that these different cross-sectional arrays give an unique visual, hand, and stretch effect. Similarly, FIGS. 4 and 5 depict different filament cross-sectional arrays, wherein the bicomponent yarn is round and the second yarn is dogbone-shaped 21, 22, 23 and trilobal 24, 25, 26, respectively.

It has been found that the polymer yarn of the present invention having low denier may be used for making fine fabrics, while a yarn having high denier may be used for heavier fabrics. Accordingly, the synthetic polymer yarn of the present invention may have any yarn denier suitable for its final end use product. For fine fabrics, the synthetic polymer yarn may have a sum denier of the combination of the bicomponent denier and second yarn of less than about 60, preferably less than about 50, and more preferably, less than about 40. For medium weight fabrics, the synthetic polymer yarn may have a denier of between about 50 to about 200, preferably about 70 to about 150, and more preferably about 70 to about 140. Finally, for heavier fabrics, such as load-bearing fabrics, the synthetic polymer yarn may have a denier of between about 200 to about 2400, preferably about 200 to about 2000, and more preferably about 600. Most preferably, the synthetic polymer yarn of the present invention uses a self-bulking bicomponent having a total denier and total filament selected from the group consisting of 18 denier and 8 filaments, 12 denier and 3 filaments, or 9 denier and 3 filaments combined with a 20 denier and 13 trilobal second spinnable yarn; or a self-bulking bicomponent of 70 denier and 34 filaments with a second yarn selected from the group consisting of a 70 denier and 17 filament trilobal second yarn, 40 denier and 26 filament dog bone-shaped second yarn, 86 denier and 68 filament round second yarn, and 85 denier and 92 filament round second yarn.

The invention combines the bicomponent yarn with the second yarn to form a single yarn. Each of these bicomponent yarn and second yarn may be made separately off-line and then combined to form the final synthetic polymer, or one or both may be made on-line in a continuous manner. Combining these components to form a single yarn may be conducted by any known method, including plying, cospinning, air jet texturing, false twist texturing, and covering. Plying may be conducted by twisting the yarns together in a draw twister, for example. By adjusting the turns per inch and ratios of the bicomponent yarn and second yarn, striations, which give a strong visual effect, may be obtained according to this method. For example, at higher turns per inch, shorter striations may be obtained; at short turns per inch, longer striations may be obtained. Typically, the yarns may be twisted at about 0–5 tpi, and preferably, ¼–½ tpi. Cospinning may be conducted by commingling the yarns in an interlaced jet. By modifying the air pressure used in the interlacing jets, different visual effects may be obtained. Air jet texturing may be conducted by overfeeding the core yarn and effect yarn through an air jet texturing machine at different speeds. Bulking may be conducted using a false twist texturing machine, whereas by modifying the speed of feeding the yarns may alter the visual composition of the final yarn. Covering may be performed by wrapping one yarn around the other yarn. Each of the above methods of combining two yarns are known. Based on the present disclosure, one having ordinary skill in the art would understand how to modify the feed rates, turns per minute, etc. in order to obtain the desired visual composition. Any method or machine may be used to combine the two yarns provided that the end result is a single yarn.

Moreover, the bicomponent yarn and second yarn may be combined in any arrangement. For example, where these components are used as core and effect yarns, either the bicomponent yarn or second yarn may be used as the core yarn. If the yarns are combined by covering, either the bicomponent yarn or the second yarn may be used to wrap the other yarn.

FIGS. 1 and 2 depict two embodiments of making the polymer yarns of the present invention. The spinneret may be designed to form the bicomponent yarn so that in forming a molten stream, each of the molten polymers may be extruded through a separate capillary so as to converge at the spinneret face to form the molten stream or the polymers may be combined and then extruded through a common spinneret capillary to form the molten stream. Moreover, the spinneret may be designed to form the second yarn concurrently with the bicomponent yarn. FIG. 1 shows a method of making the partially oriented synthetic polymer yarns, wherein molten polymers 1, 2, and 3 are extruded through separate capillaries 4 and converge below the spinneret face 5. The molten polymers 2 and 3 combine just below the spinneret face 5 to form bicomponent filaments 6. These filaments 6 are packed together to form the bicomponent yarn 7. The bicomponent yarn may be stretched prior to or after it is combined with the second yarn, and may be treated by known means, such as by heating or steaming the yarn to allow the bicomponent yarn to bulk.

Referring again to FIG. 1, the molten polymer 1 making up the second yarn 9 is extruded through a separate capillary 4 and the filaments 8 made thereby are packed together to form the second yarn 9. As described above, the second yarn may be a single component drawn yarn or a bicomponent yarn. FIG. 1 depicts the second yarn as a single component partially oriented yarn. The bicomponent yarn 7 and thermoplastic melt spinnable yarn 9 are then introduced into separate interlacing jets 10 and 11, which may be operated at a pressure sufficient to prevent filament splaying. The air pressure used to control the splaying may depend upon the particular type of interlacing jets selected, but is generally about 10 psi to 80 psi, preferably 20 psi to 60 psi. The separate yarns 12 and 13 are brought together and drawn together in another interlace jet 14 operated under a pressure of about 10 psi to 80 psi, preferably 20 psi to 60 psi, most preferably about 30 psi. The polymer yarn 15 produced is then wound up on packages 16 at speeds in excess of about 2,000 ypm operated at a tension of 0.1–0.4 gms/denier.

FIG. 2 depicts a method of making a fully drawn yarn, wherein a roll arrangement 17 and 18 is used to adjust the tension of the yarn through interlacing jets and to the winder 16.

While FIGS. 1 and 2 indicate that the two yarns are combined while they are yarns, it is also useful to combine them before the yarns are formed, for example, as filaments, or in or before the spinneret.

The synthetic polymer yarns may be used to form fabrics by known means including by warp knitting, circular knitting, or hosiery knitting, or a staple product laid into a non-woven fabric.

The synthetic polymer yarn or bicomponent effect yarns may be used to produce fabrics that have a strong visual effect and unique tactile qualities. In particular, an unusually strong effect was found in lighter denier or lighter weight fabrics. In particular, an unusually strong effect was found in lighter denier or lighter weight fabrics.

For example, some bicomponent effect yarns of the present invention have been shown to provide fabrics which are stratified. In a fabric made from preferred yarns of the invention, it is believed that the bicomponent yarn and second yarn within the bicomponent effect yarn variably segregate to one surface or the opposite surface of the fabric, and the variability in the degree of segregation provides advantages visual and tactile properties, such as stratification, not obtained by other methods. The preferred bicomponent effect yarns provide fabrics with stratification.

A preferred yarn is one where the yarn denier of the bicomponent is about the same as the effect yarn and the number of filaments per yarn in the bicomponent is about one half that of the effect yarn. Another preferred yarn variation is one where the bicomponent yarn denier is about two times the yarn denier of the effect yarn and the number of filaments is about the same.

A more preferred yarn variation is one where the effect yarn cross section profile is other than circular (round), e.g., trilobed or dog bone.

Other preferred yarns are those where the bicomponent is 15–40 denier with 6–18 filaments and the effect yarn is 18–22 denier with 10–15 filaments (of profiled cross section).

Figure 6A:
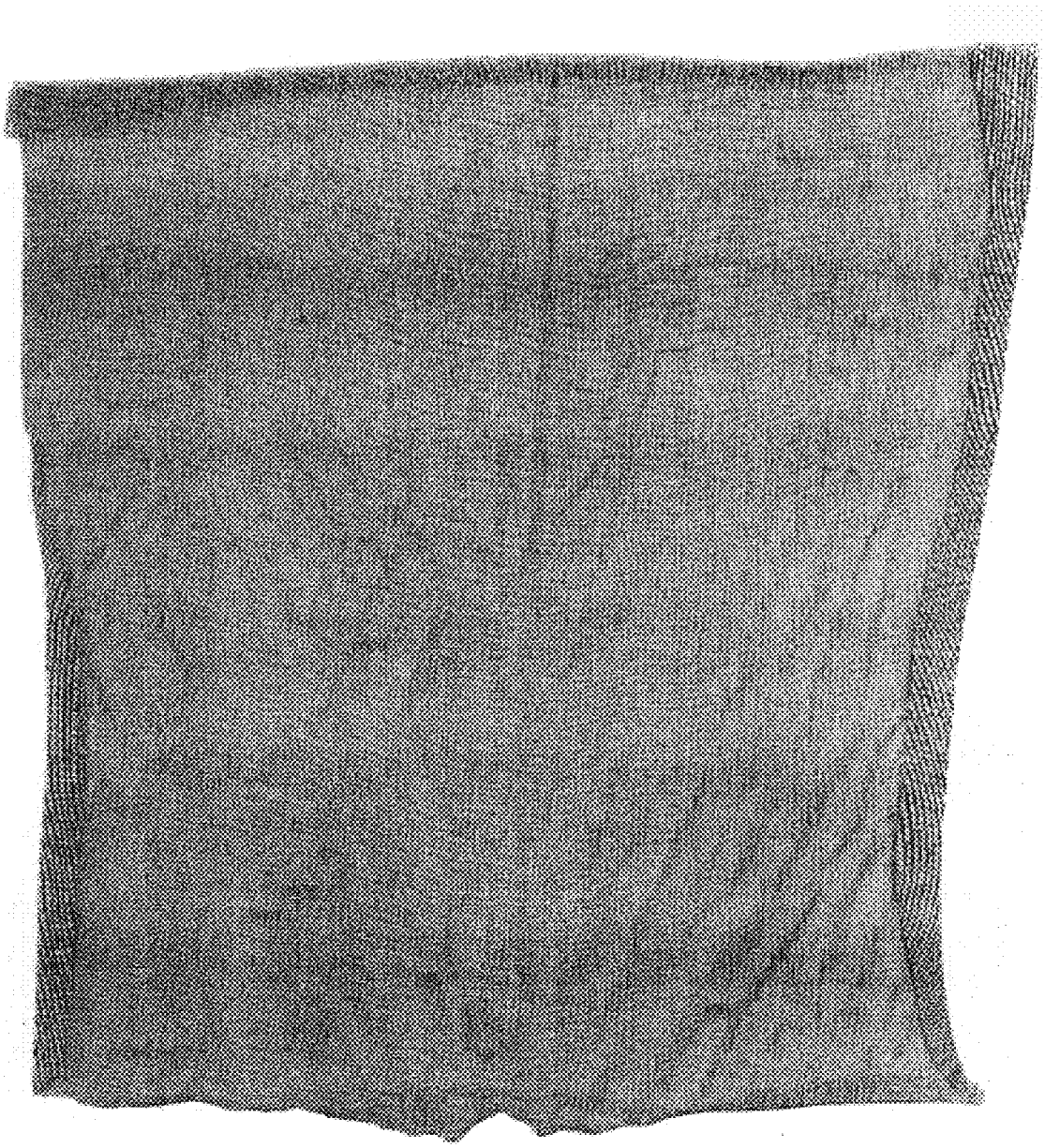
FIGS. 6A and 6B and 6C are photomicrographs that depict the visual effect of fabric produced from a polymer yarn made from a combination of a bicomponent yarn and a single component yarn (6B), as compared to a control fabric produced from two single component yarns (6A).
Figure 6B:
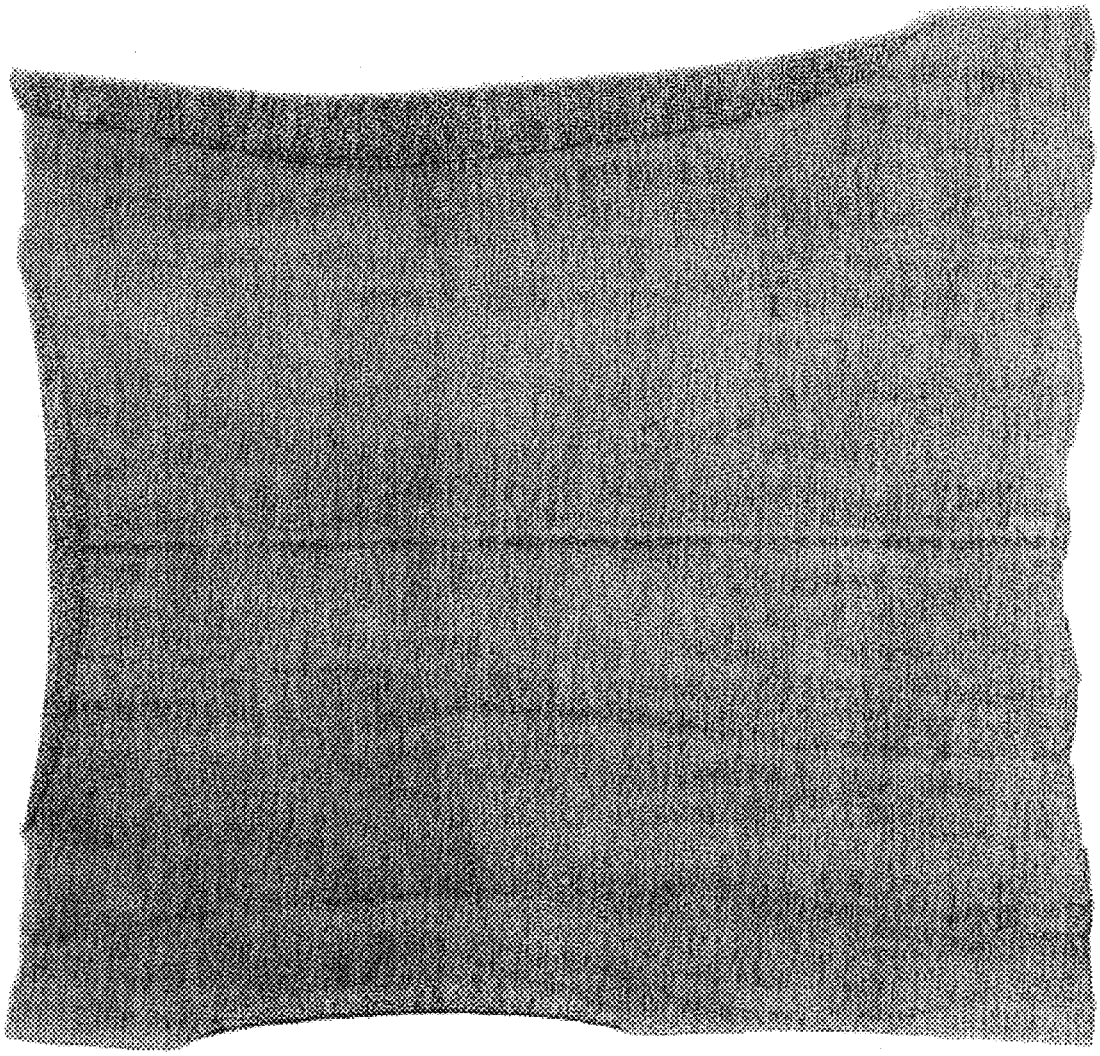

FIG. 6 provides a comparison between a control fabric made from a single component hard yarn and a stratified fabric made from a synthetic polymer yarn of the present invention. FIG. 6A shows a fabric knitted from the yarn of Comparative Example A, wherein two yarns made up of the homopolymer nylon 66 were combined, wherein the first yarn has a round cross-section and the second yarn has a trilobal cross-section. FIG. 6B shows a fabric knitted from the yarn of Example 3, wherein a bicomponent yarn and a second yarn were combined according to the present invention. From this figure, it is apparent that the striations created from the combination of the bicomponent yarns and second yarns as seen in FIG. 6B provide an unique visual aesthetic.

Moreover, the fabrics made up from the synthetic polymer bicomponent effect yarns of the present invention have excellent stretch and recovery properties. The stretch and recovery is evaluated subjectively by pulling on the fabrics and observing that the fabrics return to their original shape when the fabric is released. It has been found that the stretch of the fabrics may be obtained by having a larger fraction of the bicomponent yarn in the final synthetic polymer bicomponent effect yarn.

The "hand" of the fabrics refers to the feel or tactile aesthetics of the fabric. Fabrics made from the synthetic polymer yarns of the present invention are smoother and have less pick propensity than other known products. In addition the fabrics have a soft cotton-like hand, especially when the yarns are nylons. In particular, the hand of knit fabrics, when made with the yarn of the invention, was unexpectedly soft. For example, circular knits made with the yarn of the present invention have an excellent soft hand as well as very good stretch and recovery, which is in marked contrast to the often 'boardy' hand observed when knits were made entirely of bicomponent fibers.

Moreover, since the yarns of the present invention are preferably made up of nylon polymers, these yarns and fabrics can be easily dyed and are more durable.

The measurements for crimp potential, crimp index shrinkage, and relative viscosity may be conducted by any known method. The crimp potential and crimp index shrinkage, for example, may be determined by measuring a yarn skeing length under standard loads before and after a shrink-causing treatment. However, the choice of method and conditions can have an effect on the properties, for example, different values can be obtained if different loads are used in the crimp potential test.

Crimp potential is a measure of the bulk developed in yarn by exposure to 95° C. water. It is the difference between stretched (or loaded) and unstretched (or not loaded) lengths after crimping/bulking treatment.

A 1050 denier skein of yarn was wound on a denier reel with the required revolutions to give a skein approximately 44 in (112 cm) long. The skein was hung on a rotary magazine and conditioned for at least 30 minutes under 2.5 gms load. A 700 gm weight was then hung from the suspended skein, and the initial length of the skein (L1) was measured. The 700 gm weight was then replaced with a 2.5 gm weight to provide a tensile loading of 1.2 mg/denier. The magazine with the suspended skein was then submerged under water in a bath, controlled at a temperature of 95° C. ±2° C. for 1.5 minutes. The skein/magazine assembly was then removed from the water bath and allowed to dry for at least 3.5 hours. The length of the crimped skein (L2) with the 2.5 gm load was measured. Finally, the 2.5 gm weight was replaced by the 700 gm weight and the length (L3) was measured.

The crimp potential (CP) in percent is computed as:

$$\% \, CP = (L3 - L2)/L2 \times 100$$

The crimp shrinkage (CS) in percent is calculated as:

$$\% \, CS = (L1 - L3)/L1 \times 100$$

The relative viscosity may be measured by any known method. The term "relative viscosity," as used herein, is the ratio of flow time in a viscometer of a polymer solution containing 8.2.+−.0.2% by weight of polymer to the flow time of the solvent by itself wherein the solvent is 90% by weight formic acid.

The invention will now be illustrated by the following non-limiting examples.

EXAMPLE 1

A 57 total denier synthetic polymer yarn of 29 filaments was made by plying together a yarn of 13 trilobal filaments having a total denier of 20, and a self-bulking bicomponent yarn of 37 denier and 16 filaments in a draw twister at a speed of about ¼ turn per inch. The trilobal yarn was comprised of nylon 66. The bicomponent self-bulking yarn was made up of nylon 66 copolymerized with 30% poly-2-methylpentamethyleneadipamide (MPMD) as the high RV component and nylon 66 as the low RV component. The high RV component was synthesized by mixing adipic acid, diamine, and MPMD together in a salt and copolymerizing. The bicomponent yarn had an oval-shaped cross-section. One component of the self-bulking yarn had an RV of about 52 and the other component of the self-bulking yarn had an RV of about 39. The "delta RV" is the difference between the RV's of each of the components of the bicomponent yarn. The synthetic polymer yarn was knitted on a 75 gage LAWSON knitting machine to make 6 inch tubes. Duplicate sets of tubes were knitted and pot dyed. The tubes were scoured at boil at 212° F. for 15 minutes, then dyed at a minimum of 140° F. to exhaust the dye for 10 minutes, and then allowed to air dry. The dyed knit tubes were rated for visual effects and hand and found to be superior as compared to the control dyed knit tubes.

EXAMPLE 2

A 38 total denier synthetic polymer yarn of 21 filaments was made analogous to Example 1 from a yarn of 20 denier, 13 trilobal filaments and an 18 denier, 8 filament self-bulking bicomponent yarn. The trilobal yarn was composed of nylon 66 and the bicomponent yarn was made up of 60% nylon 66 copolymerized with 30% MPMD and 40% nylon 66. The synthetic polymer yarn was knitted on a 75 gage LAWSON knitting machine to make 6 inch tubes. Duplicate sets of tubes were knitted and pot dyed. The tubes were scoured at boil at 212° F. for 15 minutes, then dyed at a minimum of 140° F. to exhaust the dye for 10 minutes, and then allowed to air dry. The dyed knit tubes were rated for visual effects and hand, and found to be superior as compared to the control dyed knit tubes.

EXAMPLES 3–19

Synthetic polymer yarns were made analogous to the method described in Example 1 having the denier and filaments, yarn compositions, and delta RVs of the bicomponent yarn, as set forth in Table 1. Different speeds at which the yarns were plied together in the draw twister may have been used to obtain satisfactory results. Fabrics were woven with these synthetic polymer yarns and observed for hand, stretch and recovery, and stratified visual effects. Table 1 provides the results for each of the fabrics. Each of the fabrics having a bicomponent yarn was found to have a nice soft hand. Moreover, with respect to the stretch and recovery, it was found that the stretch varied depending upon the amount of bicomponent in the synthetic polymer yarn. The greater the bicomponent yarn fraction, the greater the stretch.

In the fabric of Example 16, the synthetic polymer yarn was a bicomponent yarn combined with a second yarn, wherein both the bicomponent yarn and second yarn had the same denier per filament ratios. While it is often advantageous that there be a contrast in denier per filament to obtain a desired visual effect, the yarn of Example 16 showed a strong effect despite the fact that there was no contrast in denier per filament ratios.

In addition, it was noted that where two bicomponent yarns were combined, as in Example 19, there was less visual effect, but a soft cotton-like and velvety hand was still attained.

COMPARATIVE EXAMPLES A-B

Synthetic polymer yarns were made using the yarns having the denier and filaments set forth in Table 1. The fabrics made from these yarns did not provide the stratification effects, or the smooth, silky hand relative to the Examples 1–21.

EXAMPLE 20

70 denier, 34 filament Tactel® Ispira® bicomponent yarn, made up 60% nylon 66 copolymerized with 30% MPMD and 40% nylon 66, was used as the core in an air jet textured combination yarn with 86 denier, 68 filament dull round homopolymer of nylon 66 yarn as the effect yarn, made up of nylon 66, to create a 156 denier, 102 filament air jet textured yarn. The air jet texturing combination was made by feeding the core bicomponent yarn at a speed of about 400–600 meters per minute into an air jet while feeding the effect yarn at a 30% higher rate into the same jet. The combined yarn was then woven as a fill yarn along with a 206 denier, 68 filament warp yarn in a 2×2 twill fabric. The woven fabric was dyed in a relaxed fashion to allow the bicomponent to bulk. The resulting fabric was then tentered in an oven to heat set the fabric and establish a desired fabric weight. The 100% nylon fabric thus made provided one step comfort stretch in the fill direction as well as an extremely soft cotton-like hand.

EXAMPLE 21

A 70 denier, 34 filament Tactel® Ispira® bicomponent yarn, made up 60% nylon 66 copolymerized with 30% MPMD and 40% nylon 66, was used as the core in an air jet textured combination yarn with 85 denier, 92 filament round homopolymer of nylon 66 air jet textured yarn, made up of nylon 66 to produce a 155 denier, 126 filament yarn. The air jet textured combination was made as in Example 20, above. When this yarn was knit as the single yarn on a seamless Santoni knitting machine, then dyed in a relaxed manner to allow the bicomponent yarn to bulk, it gave a superior cotton-like soft hand with excellent stretch and recovery.

EXAMPLE 22

A 110 total denier synthetic polymer yarn of 60 filaments is made by plying together a bicomponent yarn having a total denier of 70 and 34 oval filaments, and a homopolymer nylon 66 dog bone-shaped yarn at a speed of about ¼ turns per inch. The bicomponent yarn consists of 60% polyethylene terephthalate and 40% polypropylene terephthalate. The synthetic polymer yarn may be knitted on a 75 gage LAWSON knitting machine to make 6 inch tubes. Duplicate sets of tubes may then be knitted and pot dyed. The tubes are scoured at boil at a minimum of 212° F. for 15 minutes, then dyed at a minimum of 140° F. to exhaust the dye for 10 minutes, and then allowed to air dry. The dyed knit tubes were rated for visual effects and hand and were found to be superior as compared to the control dyed knit tubes.

TABLE 1

| EX. | Total denier and filaments | Bicomponent Denier and filaments | Bicomponent yarn composition | DELTA RV Of Components of Bicomponent Yarn | Second yarn Denier and Filaments | Second yarn composition and shape | STRATIFIED EFFECT |
|---|---|---|---|---|---|---|---|
| 1 | 57/29 | 37/16 | Bicomponent (oval): 60% (nylon 66 copolymerized with 30% MPMD) and 40% nylon 66 | 15–20 | 20/13 | Homopolymer nylon 66 (trilobal) | VERY GOOD |
| 2 | 38/21 | 18/8 | Bicomponent (oval): 60% (nylon 66 copolymerized with 30% MPMD) and 40% nylon 66 | 15–20 | 20/13 | Homopolymer nylon 66 (trilobal) | VERY GOOD |
| 3 | 38/21 | 18/8 | Bicomponent (oval): 60% (nylon 66 copolymerized with 30% MPMD) and 40% nylon 66 | 15–20 | 20/13 | Homopolymer nylon 66 (trilobal) | VERY GOOD |
| 4 | 29/16 | 9/3 | Bicomponent (oval): 60% (nylon 66 copolymerized with 30% MPMD) and 40% nylon 66 | 15–20 | 20/13 | Homopolymer nylon 66 (trilobal) | FAIR |
| 5 | 29/16 | 9/3 | Bicomponent (oval): 60% (nylon 66 copolymerized with 30% MPMD) and 40% nylon 66 | 15–20 | 20/13 | Homopolymer nylon 66 (trilobal) | GOOD |
| 6 | 39/15 | 9/3 | Bicomponent (oval): 60% (nylon 66 copolymerized with 30% MPMD) and 40% nylon 66 | 15–20 | 30/12 | Homopolymer nylon 66 (semidull round) | GOOD |
| 7 | 49/16 | 9/3 | Bicomponent (oval): 60% (nylon 66 copolymerized with 30% MPMD) and 40% nylon 66 | 15–20 | 40/13 | Homopolymer nylon 66(semidull round) | NO EFFECT |
| 8 | 49/29 | 9/3 | Bicomponent (oval): 60% (nylon 66 copolymerized with 30% MPMD) and 40% nylon 66 | 15–20 | 40/26 | Homopolymer nylon 66 (trilobal) | FAIR-GOOD |
| 9 | 32/16 | 12/3 | Bicomponent (oval): 60% (nylon 66 copolymerized with 30% MPMD) and 40% nylon 66 | 20–30 | 20/13 | Homopolymer nylon 66 (trilobal) | FAIR-GOOD |
| 10 | 58/34 | 18/8 | Bicomponent (oval): 60% (nylon 66 copolymerized with 30% MPMD) and 40% nylon 66 | 15–20 | 40/26 | Homopolymer nylon 66 (dog-bone shaped) | GOOD |
| 11 | 52/29 | 12/3 | Bicomponent (oval): 60% (nylon 66 copolymerized with 30% MPMD) and 40% nylon 66 | 20–30 | 40/26 | Homopolymer nylon 66 (dog-bone shaped) | GOOD |
| 12 | 27/10 | 12/3 | Bicomponent (oval): 60% (nylon 66 copolymerized with 30% MPMD) and 40% nylon 66 | 20–30 | 15/7 | Homopolymer nylon 66 (semidull round) | FAINT |
| 13 | 42/15 | 12/3 | Bicomponent (oval): 60% (nylon 66 copolymerized with 30% MPMD) and 40% nylon 66 | 20–30 | 30/12 | Homopolymer nylon 66 (semidull round) | FAIR-GOOD |
| 14 | 140/51 | 70/34 | Bicomponent (oval): 60% (nylon 66 copolymerized with 30% MPMD) and 40% nylon 66, where total denier is 40–140 denier | 15–20 | 70/17 (bicomponent) | Homopolymer nylon 66 (trilobal bright) | GOOD |
| 15 | 110/60 | 70/34 | Bicomponent (oval): 60% (nylon 66 copolymerized with 30% MPMD) and 40% nylon 66, where total denier is 40–140 denier | 15–20 | 40/26 | Homopolymer nylon 66 (dog-bone shaped) | GOOD |
| 16 | 140/68 | 70/34 | Bicomponent (oval): 60% (nylon 66 | 15–20 | 70/34 | Homopolymer nylon 66 (trilobal | GOOD |

TABLE 1-continued

| | | | | | | | |
|---|---|---|---|---|---|---|---|
| | | | copolymerized with 30% MPMD) and 40% nylon 66, where total denier is 40–140 denier | | (bicomponent) | bright) | |
| 17 | 52/29 | 12/3 | Bicomponent (oval): 60% (nylon 66 copolymerized with 30% MPMD) and 40% nylon 66 | 20–30 | 40/26 | Homopolymer nylon 66 (trilobal) | GOOD |
| 18 | 24/10 | 9/3 | Bicomponent (oval): 60% (nylon 66 copolymerized with 30% MPMD) and 40% nylon 66 | 15–20 | 15/7 | Homopolymer nylon 66(semidull round) | NO EFFECT |
| 19 | 49/19 | 12/3 | Bicomponent (oval): 60% (nylon 66 copolymerized with 30% MPMD) and 40% nylon 66 | 20–30 | 37/16 | Bicomponent: 60% (nylon 66 copolymerized with 30% MPMD) and 40% nylon 66; delta RV = 15–20 | Very little strata, but hand was smooth and velvet |
| 20 | 156/102 | 70/34 | Bicomponent (oval): 60% (nylon 66 copolymerized with 30% MPMD) and 40% nylon 66, where total denier is 40–140 denier | 15–20 | 86/68 | Homopolymer nylon 66 (dull round) | NO EFFECT but cotton-like hand |
| 21 | 155/126 | 70/34 | Bicomponent (oval): 60% (nylon 66 copolymerized with 30% MPMD) and 40% nylon 66, where total denier is 40–140 denier | 15–20 | 85/92 | Homopolymer nylon 66 (round) | NO EFFECT but cotton-like hand |

| EX. | Total yarn A/B (dpf) | Yarn A (dpf) | Yarn A composition | Yarn B (dpf) | Yarn B composition | Stratification Effect |
|---|---|---|---|---|---|---|
| A | 35/20 | 15/7 | Homopolymer nylon 66 (semidull round) | 20/13 | Homopolymer nylon 66 (trilobal) | NO EFFECT |
| B | 50/19 | 20/7 | Homopolymer nylon 66 (trilobal bright with antistatic/delustrant agent) | 30/12 | Homopolymer nylon 66 (semidull round) | NO EFFECT |

EXAMPLE 23

Figure 6C:
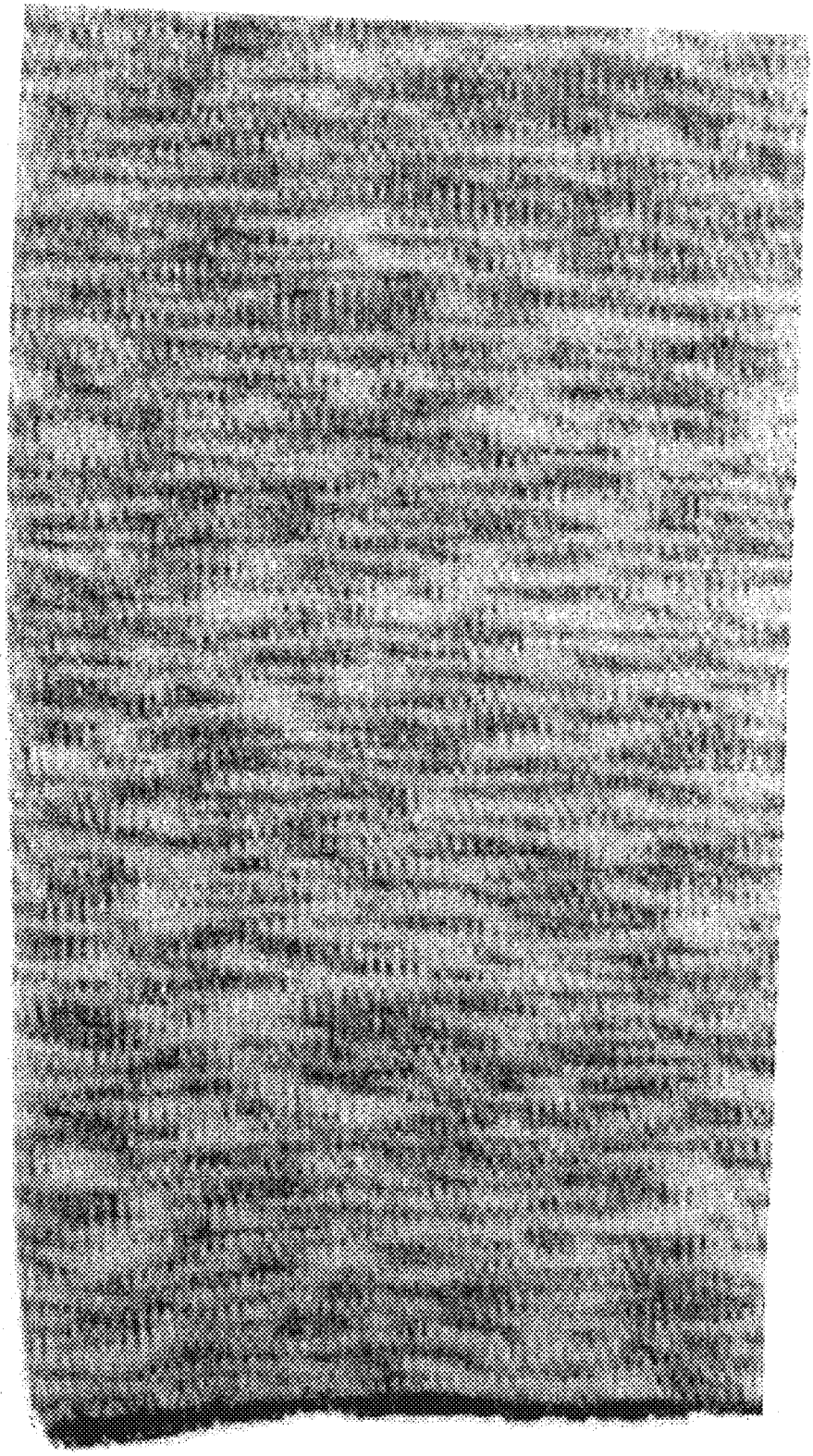

A 110 total denier (122 decitex) bicomponent effect yarn of 62 filaments was made analogously to Example 1. Each 110 denier yarn contained 28 dog-bone shaped (bilobal) of 70 denier (78 dtex) total and 34 filaments of self-bulking yarn bicomponent yarn of 40 denier (44 dtex) total. The bilobal yarn was comprised of homopolymer nylon 66. The self-bulking bicomponent yarn (available from E. I. du Pont de Nemours and Company) was comprised of 40 wt % poly(ethylene terephthalate) and 60 wt % poly(trimethylene terephthalate), and had a crimp contraction level of about 45% (as determined by the crimp contraction test method but with a 225° F. (107° C.) oven) and a crimp potential of 53%. This effect yarn was knitted on a 75 gauge LAWSON knitting machine set for making 6 inch tubes. Duplicate sets of tubes were knitted and pot dyed, using acid dyes, which dyed the nylon well and the polyester bicomponent lightly. These dyed knit tubes were scoured at, 100° C.—, for 15 minutes, followed by dyeing at a minimum of 124° C. to exhaust the dye for 10 minutes. These dyed tubes were allowed to air dry. The dyed knit tubes were rated for visual effects and hand and found to be superior as compared to the control dyed knit tubes. FIG. 6C shows the appearance of one of the samples in which the nylon was dyed and the poly(ethylene terephthalate)/poly(trimethylene terephthalate) combination yarn remained very light colored. This fabric tube showed excellent stretch and recovery a cotton-like hand and a very good stratified effect.

EXAMPLE 24

A 134 total denier (149 decitex) bicomponent effect yarn of 140 filaments was made substantially as in Example 1 but from a 70 filament (34 decitex), 34 denier 2G-T//3G-T 40//60 polyester bicomponent yarn (available from E. I. du Pont de Nemours and Company) having a crimp contraction level of 70% with a 70 filament 100 denier (111 decitex) poly(ethylene terephthalate) yarn ("Polyset" "textured set", from Glen Raven, Inc.) The combined yarn had a Z-twist of 0.25 turns per inch (0.6 turns/cm). The yarn was knit substantially as in Example 23, scoured at the boil with Merpol® HCS surfactant (a registered trademark of E. I. du Pont de Nemours and Company) and disperse-dyed with a mixture of 0.5 wt % C.I. Disperse Blue 60 and 0.1 wt % C.I. Disperse Orange 25 (based on weight of fiber), and air-dried. The dyed fiber had a fair to good stratification effect.

EXAMPLE 25

This example demonstrates the increase in recoverable stretch, in both warp and weft directions, obtained by the inventive fabric.

A 450 total denier (500 decitex), 102 filament bicomponent effect yarn was made by intermingling a single end of 150 denier (167 decitex), 34 filament 2G-T//3G-T 40//60 polyester bicomponent yarn (available from E. I. du Pont de Nemours and Company) having a crimp contraction level of about 70% with two ends of a 150 denier (167 decitex), 34 filament poly(ethylene terephthalate) yarn containing about 2 wt % carbon black. The intermingling was accomplished by draw-texturing a partially oriented monocomponent poly (ethylene terephthalate) yarn and, after the heating and drawing steps of the texturing operation, feeding the bicomponent yarn with the just-textured monocomponent yarn to the windup stage. Woven 3×1 twill example fabrics were prepared using the bicomponent effect yarn as each weft end and, as each warp end, three plies of the 150 denier (167 decitex) 102 filament draw-textured poly(ethylene terephthalate) yarn containing about 2 wt % carbon black. The warp density was 76 ends/inch (30 ends/cm). In one fabric, the weft density was 40 ends/inch (15.7 ends/cm), and in another, 32 ends/inch (12.6 ends/cm). Each fabric showed a good stratification effect. A control fabric was prepared by weaving with 76 warp ends per inch and with 40 weft ends per inch. This control fabric contained the same warp yarns as the 76 warp end/inch by 40 weft end/inch example and was identical in construction except for the fill yarns, which were of an equivalent denier plied yarn made from 100% poly(ethylene terephthalate) and containing about 2 wt % carbon black. This control fabric was finished by boiling off for 2 minutes. No stratification effect was shown by this control fabric. Hand stretching measurements on the control fabric and on the 76 warp end/inch by 40 weft end/inch example fabric showed a recoverable stretch in the weft direction twice that of the control. In the warp direction of the 76 warp end/inch by 40 weft end/inch example fabric the recoverable stretch was about 25% greater than the warp direction stretch of the control fabric. The observed stratification in the example fabrics is believed to be responsible for opening up the fabric structure and providing a superior recoverable stretch property versus the control.

Those skilled in the art, having the benefit of the teachings of the present invention as hereinabove set forth, can effect numerous modifications thereto. These modifications are to be construed as being encompassed within the scope of the present invention as set forth in the appended claims.

What is claimed is:

1. A fabric, comprising a bicomponent effect yarn formed from a filament bicomponent yarn and a second filament yarn, wherein said bicomponent yarn comprises at least a first component and a second component which each have different shrinkages and are each present in a sufficient amount to give a bulking effect to the bicomponent yarn.

2. The fabric of claim 1, wherein the first component and the second component of the bicomponent yarn are each individually formed from the group consisting of a homopolymer, copolymer, terpolymer, and combinations thereof, of a polyamide, a polyolefin, polyester, viscose polymer, or acetate.

3. The fabric of claim 2, wherein said first or second component of the bicomponent yarn is formed from a polyamide selected from nylon 66, nylon 6, nylon 7, nylon 10, nylon 12, nylon 46, nylon 610, nylon 612, nylon 1212, or any combinations thereof.

4. The fabric of claim 3, wherein said polyamide is copolymerized with an additional dicarboxylic acid or diamine.

5. The fabric of claim 3, wherein said polyamide is formed from adipic acid, hexamethylene diamine, and poly-2- methylpentamethylenedipamide.

6. The fabric of claim 1, wherein said first component and said second component of the bicomponent yarn have different relative viscosities.

7. The fabric of claim 1, wherein said second yarn of the bicomponent effect yarn is selected from a homopolymer, copolymer, terpolymer, and combinations thereof, of a polymer selected from the group consisting of polyamides, polyolefins, polyesters, viscose polymers, acetate, cotton, wool, silk, and combinations thereof.

8. The fabric of claim 7, wherein said second yarn is non-elastomeric.

9. The fabric of claim 7, wherein said second yarn is melt-spinnable.

10. The fabric of claim 7, wherein said second yarn is selected from the group consisting of nylon 66, nylon 6, nylon 7, nylon 10, nylon 12, nylon 46, nylon 610, nylon 612, nylon 1212, and combinations thereof.

11. The fabric of claim 1, wherein said first component of the bicomponent yarn comprises a monomer used to form nylon 66 copolymerized with poly-2-methylpentamethleneadipamide and the second component comprises nylon 66, and wherein said second yarn comprises a homopolymer of nylon 66 .

12. A garment comprised of the fabric of claim 1.

13. The fabric of claim 1, wherein the bicomponent yarn and the second yarn each comprise filaments, and further wherein said bicomponent filaments and said second yarn filaments are combined to form a single synthetic polymer yarn.

14. The fabric of claim 1 wherein the bicomponent yarn and second yarn are each continuous filaments, a first component of the bicomponent yarn is selected from the group consisting of poly(ethylene terephthalate) and copolymers thereof, and a second component of the bicomponent yarn is selected from the group consisting of poly (trimethylene terephthalate) and poly (tetramethylene terephthalate).

15. The fabric of claim 1 wherein the second yarn is comprised of one or more polymers selected from the group consisting of poly(ethylene terephthalate) and copolymers thereof.

16. The fabric of claim 1, wherein the second yarn is comprised of one or more polymers selected from the group consisting of nylon 66, nylon 6, and copolymers thereof.

17. The fabric of claim 15 wherein the second component of the bicomponent is poly(trimethylene terephthalate).

18. The fabric of claim 1 having a knit construction.

19. The fabric of claim 1, wherein the second filament yarn comprises a synthetic polymer.

* * * * *